US006682780B2

(12) United States Patent
Tzatzov et al.

(10) Patent No.: US 6,682,780 B2
(45) Date of Patent: Jan. 27, 2004

(54) PROTECTIVE SYSTEM FOR HIGH TEMPERATURE METAL ALLOY PRODUCTS

(75) Inventors: Konstantin K. Tzatzov, Sherwood Park (CA); Alexander S. Gorodetsky, Sherwood Park (CA); Andrew Wysiekierski, Okanagan Falls (CA); Gary Anthony Fisher, Edmonton (CA)

(73) Assignee: Bodycote Metallurgical Coatings Limited, Newbridge (GB)

( * ) Notice: Subject to any disclaimer, the term of this patent is extended or adjusted under 35 U.S.C. 154(b) by 0 days.

(21) Appl. No.: 10/152,002

(22) Filed: May 22, 2002

(65) Prior Publication Data

US 2002/0192494 A1 Dec. 19, 2002

(30) Foreign Application Priority Data

May 22, 2001 (CA) ..... 2348145

(51) Int. Cl.[7] ..... B22F 7/00; B22F 5/12; C23C 24/00; C23C 30/00

(52) U.S. Cl. ..... 427/383.1; 427/452; 427/455; 427/191; 427/205; 427/383.7; 427/419.1; 419/31; 419/45; 419/10; 228/262.3; 228/262.4

(58) Field of Search ..... 419/30, 32, 34, 419/31, 45, 10, 56, 57, 60, 62; 427/452, 455, 456, 523, 528, 531, 532, 569, 581, 585, 191, 192, 205, 249.15, 388.1, 404, 405, 383.1, 383.7, 419.1, 435; 228/262.1, 262.3, 262.4

(56) References Cited

U.S. PATENT DOCUMENTS 4,532,191 A * 7/1985 Humphries et al. ..... 428/678
5,403,629 A 4/1995 Eichmann et al. ..... 427/576
5,700,423 A * 12/1997 Gao ..... 266/103
5,958,332 A 9/1999 Hoeg ..... 420/442
5,997,604 A * 12/1999 Rafferty et al. ..... 75/233
6,165,286 A * 12/2000 Bayer et al. ..... 148/220
6,475,647 B1 * 11/2002 Mendez Acevedo et al. .... 428/678

FOREIGN PATENT DOCUMENTS

DK 165125 2/1993
EP 0 208 487 * 1/1987

OTHER PUBLICATIONS

U.S. patent application Ser. No. 09/589,196, Fisher et al., filed Jun. 8, 2000.
U.S. patent application Ser. No. 09/690,447, Acevedo et al., filed Oct. 18, 2000.
"Processing and Properties of Materials" entitled "The Effect of Time at Temperature on Silicon–Titanium Diffusion Coating on IN738 Base Alloy" by M.C. Meelu and M.H. Lorretto, p. 1241–1246, no date.

* cited by examiner

*Primary Examiner*—Michael LaVilla
(74) *Attorney, Agent, or Firm*—Arne I. Fors

(57) ABSTRACT

A method for protecting low-carbon steel and stainless steel from coking and corrosion at elevated temperatures in corrosive environments, such as during ethylene production by pyrolysis of hydrocarbons or the reduction of oxide ores, by coating the stainless steel with a coating of MCrAlXSiT in which M is nickel, cobalt, iron or a mixture thereof, X is yttrium, hafnium, zirconium, lanthanum, scandium or combination thereof, and T is tantalum, titanium, platinum, palladium, rhenium, molybdenum, tungsten, niobium, boron or combination thereof. A blended powder composition to produce a desired MCrAlXSiT surface alloy may be applied to the substrate. The overlay coating and stainless steel substrate preferably are heat-treated at about 1000 to 1200° C. for about 10 minutes or longer effective to metallurgically bond the overlay coating to the substrate and to form a multiphased microstructure.

10 Claims, No Drawings

PROTECTIVE SYSTEM FOR HIGH TEMPERATURE METAL ALLOY PRODUCTS

BACKGROUND OF THE INVENTION (i) Field of the Invention

The present invention relates to coating systems for the generation of protective surface alloys for high temperature metal alloy products and, more particularly, relates to the provision of metal alloy coatings on the internal wall surfaces of high-temperature stainless steel tubes and fittings to produce a coating that provides corrosion resistance, erosion resistance and reduces the formation of catalytic coking in the hydrocarbon processing such as in olefin production and in direct reduction of ores. The protection system also has application on carbon steels. For example, in downhole oil and gas applications, the protective system enhance erosion properties compared to carbon steel commonly used.

(ii) Description of the Related Art

Stainless steels are a group of alloys based on iron, nickel and chromium as the major constituents, with additives that can include carbon, tungsten, niobium, titanium, molybdenum, manganese, and silicon to achieve specific structures and properties. The major types are known as martensitic, ferritic, duplex and austenitic steels. Austenitic stainless steel generally is used where both high strength and high corrosion resistance is required. One group of such steels is known collectively as high temperature alloys (HTAs) and is used in industrial processes that operate at elevated temperatures generally above 650° C. and extending to the temperature limits of ferrous metallurgy at about 1150° C. The major austenitic alloys used have a composition of iron, nickel or chromium in the range of 18 to 42 wt. % chromium, 18 to 48 wt. % nickel, balance iron and other alloying additives. Typically, high chromium stainless steels have about 31 to 38 wt % chromium and low chromium stainless steels have about 20 to 25 wt % chromium.

The bulk composition of HTAs is engineered towards physical properties such as creep resistance and strength, and chemical properties of the surface such as corrosion resistance. Corrosion takes many forms depending on the operating environment and includes carburization, oxidation and sulfidation. Protection of the bulk alloy is often provided by the surface being enriched in chromium oxide (chromia). The specific compositions of the alloys used represent an optimization of physical properties (bulk) and chemical properties (surface). The ability of addressing the chemical properties of the surface through a surface alloy, and physical properties through the bulk composition, would provide great opportunities for improving materials performance in many severe service industrial environments.

Surface alloying can be carried out using a variety of coating processes to deliver the right combination of materials to the component's surface at an appropriate rate. These materials would need to be alloyed with the bulk matrix in a controlled manner that results in a microstructure capable of providing the pre-engineered or desired benefits. This would require control of the relative interdiffusion of all constituents and the overall phase evolution. Once formed, the surface alloy can be activated and reactivated, as required, by a reactive gas thermal treatment. Since both the surface alloying and the surface activating require considerable mobility of atomic constituents at temperatures greater than 700° C., HTA products can benefit most from the procedure due to their designed ability of operating at elevated temperatures. The procedure can also be used on products designed for lower operating temperatures, but may require a post heat treatment after surface alloying and activation to reestablish physical properties.

Surface alloys or coating systems can be engineered to provide a full range of benefits to the end user, starting with a commercial base alloy chemical composition and tailoring the coating system to meet specific performance requirements. Some of the properties that can be engineered into such systems include: superior hot gas corrosion resistance (carburization, oxidation, sulfidation); controlled catalytic activity; and hot erosion resistance.

Two metal oxides are mainly used to protect alloys at high temperatures, namely chromia and alumina, or a mixture of the two. The compositions of stainless steels for high temperature use are tailored to provide a balance between good mechanical properties and good resistance to oxidation and corrosion. Alloy compositions which can provide an alumina scale are favoured when good oxidation resistance is required, whereas compositions capable of forming a chromia scale are selected for resistance to hot corrosive conditions. Unfortunately, the addition of high levels of aluminum and chromium to the bulk alloy is not compatible with retaining good mechanical properties and coatings containing aluminum and/or chromium normally are applied onto the bulk alloy to provide the desired surface oxide.

One of the most severe industrial processes from a materials perspective is the manufacture of olefins such as ethylene by hydrocarbon steam pyrolysis (cracking). Hydrocarbon feedstock such as ethane, propane, butane or naphtha is mixed with steam and passed through a furnace coil made from welded tubes and fittings. The coil is heated on the outerwall and the heat is conducted to the innerwall surface leading to the pyrolysis of the hydrocarbon feed to produce the desired product mix at temperatures in the range of 850 to 1150° C. An undesirable side effect of the process is the buildup of coke (carbon) on the innerwall surface of the coil. There are two major types of coke: catalytic coke (or filamentous coke) that grows in long threads when promoted by a catalyst such as nickel or iron, and amorphous coke that forms in the gas phase and plates out from the gas stream. In light feedstock cracking, catalytic coke can account for 80 to 90% of the deposit and provides a large surface area for collecting amorphous coke.

The coke can act as a thermal insulator, requiring a continuous increase in the tube outerwall temperature to maintain throughput. A point is reached when the coke buildup is so severe that the tube skin temperature cannot be raised any further and the furnace coil is taken offline to remove the coke by burning it off (decoking). The decoking operation typically lasts for 24 to 96 hours and is necessary once every 10 to 90 days for light feedstock furnaces and considerably longer for heavy feedstock operations. During a decoke period, there is no marketable production which represents a major economic loss. Additionally, the decoke process degrades tubes at an accelerated rate, leading to a shortened lifetime. In addition to inefficiencies introduced to the operation, the formation of coke also leads to accelerated carburization, other forms of corrosion, and erosion of the tube innerwall. The carburization results from the diffusion of carbon into the steel forming brittle carbide phases. This process leads to volume expansion and the embrittlement results in loss of strength and possible crack initiation. With increasing carburization, the alloy's ability of providing some coking resistance through the formation of a chromium based scale deteriorates. At normal operating temperatures, half of the wall thickness of some steel tube alloys can be carburized in as little as two years of service. Typical tube lifetimes range from 3 to 6 years.

It has been demonstrated that aluminized steels, silica coated steels, and steel surfaces enriched in manganese oxides or chromium oxides are beneficial in reducing catalytic coke formation. Alonizing™, or aluminizing, involves the diffusion of aluminum into the alloy surface by pack cementation, a chemical vapour deposition technique. The coating is functional to form a NiAl type compound and provides an alumina scale which is effective in reducing catalytic coke formation and protecting from oxidation and other forms of corrosion. The coating is not stable at temperatures such as those used in ethylene furnaces, and also is brittle, exhibiting a tendency to spall or diffuse into the base alloy matrix. Generally, pack cementation is limited to the deposition of one or two elements, the co-deposition of multiple elements being extremely difficult. Commercially, it is generally limited to the deposition of only a few elements, mainly aluminum. Some work has been carried out on the codeposition of two elements, for example chromium and silicon. Another approach to the application of aluminum diffusion coatings to an alloy substrate is disclosed in U.S. Pat. No. 5,403,620 issued to P. Adam et al. This patent details a process for the vapour deposition of a metallic interlayer on the surface of a metal component, for example by sputtering. An aluminum diffusion coating is thereafter deposited on the interlayer.

Alternative diffusion coatings have also been explored. In an article in "Processing and Properties" entitled "The Effect of Time at Temperature on Silicon-Titanium Diffusion Coating on IN738 Base Alloy" by M. C. Meelu and M. H. Lorretto, there is disclosed the evaluation of a Si—Ti coating, which had been applied by pack cementation at high temperatures over prolonged time periods.

A major difficulty in seeking an effective coating is the propensity of many applied coatings to fail to adhere to the tube alloy substrate under the specified high temperature operating conditions in hydrocarbon pyrolysis furnaces. Additionally, the coatings lack the necessary resistance to any or all of thermal stability, thermal shock, hot erosion, carburization, oxidation and sulfidation. A commercially viable product for olefins manufacture by hydrocarbon steam pyrolysis and for direct reduction of iron ores must be capable of providing the necessary coking and carburization resistance over an extended operating life while exhibiting thermal stability, hot erosion resistance and thermal shock resistance.

When tubes used in ethylene furnaces were coated with MCrAlX-alloy, an improvement on the anti-coking, anti-carburization and resistance to hot erosion properties of the tubes were observed. Deposition of these coatings onto HTA tubes such as by magnetron sputtering has been disclosed previously in U.S. patent application Ser. No. 09/589,196 filed Jun. 8, 2000.

Plasma transferred arc surface (PTAS) processes, as disclosed in U.S. patent application Ser. No. 09/690,447 filed Oct. 18, 2000 has been also used for coating HTA tubes and superalloys with MCrAlY, as disclosed in Danish Patent No.165,125 and U.S. Pat. No. 5,958,332.

Downhole oil and gas drilling, production and casing tube strings and tools conventionally are fabricated from carbon steels which are prone to corrosion and to erosion under hostile subterranean environments. There accordingly is a need for protective surface coatings on such carbon steel components.

A process entitled Controlled Composition Reaction sintering Process for Production of MCrAlY coatings disclosed in Technical Report AFML-TR-76-91 by Air Force Materials Laboratory and evaluated in a report entitled Development and Evaluation of Process for Deposition of Ni/Co—Cr—AlY (McrAlY) Coatings for Gas Turbine Components disclosed in Technical Report AFML-TR-79-4097 by Air Force Materials Laboratory performed by the Solar Division of International Harvester Company Research Laboratory, San Diego, Calif., has been used to produce a MCrAlY type coating on super-alloys. Gas turbine blades were coated with atomized MCrY-alloy using slurry containing an organic binder. The coated turbine blades were than embedded in a pack consisting of aluminum oxide ($Al_2O_3$), aluminum powder (Al), and ammonium chloride ($NH_4Cl$). The pack was heated in a controlled atmosphere under controlled time and temperature conditions to produce MCrAlY-coatings that resembled coatings deposited by a standard PVD process. The major problem with this process when applied to gas turbines is that the thickness of the coating varies and is difficult to control. In addition, the Al is added to the coating via pack aluminizing CVD process, which is environmentally unfriendly.

SUMMARY OF THE INVENTION

It is therefore a principal object of the present invention to impart beneficial properties to carbon and stainless steel materials through deposition of blended powder composition directly onto the substrate surface in order to produce a desired MCrAlXSi-alloy via a reactive sintering process.

The resulting surface alloy aims to substantially eliminate or reduce the catalytic formation of coke on the internal surfaces of tubing, piping, fittings and other ancillary furnace hardware by minimizing the number of sites for catalytic coke formation and by improving the quality of alumina scale. The alloy coatings of the invention are particularly suited for the manufacture of olefins by hydrocarbon steam pyrolysis, typified by use in furnace tubes and fittings, for ethylene production, the manufacture of other hydrocarbon-based products in the petrochemical industries, and in the direct reduction of ores such as typified by the direct reduction of iron oxide ores to metallic iron in carbon-containing atmospheres.

It is another object of the invention to increase the carburization resistance of HTAs used for tubing, piping, fittings and ancillary furnace hardware whilst in service.

It is a further object of the invention to augment the longevity of the improved performance benefits derived from the surface alloying under commercial conditions by providing thermal stability, hot erosion resistance and thermal shock resistance.

The composition of the coating, according to present invention, is controlled by blending several powders with compositions that will produce the correct MCrAlX-alloy (where M=nickel, cobalt, iron or a mixture thereof and X=yttrium, hafnium, zirconium, lanthanum, scandium or combination thereof) once the reaction sintering is completed.

In its broad aspect, the method of the invention for providing a protective and inert coating to carbon steel and stainless steel at temperatures up to 1150° C. comprises depositing onto a steel substrate and metallurgically bonding thereto a continuous overlay coating of a MCrAlXSi alloy, where M=nickel, cobalt or iron or mixture thereof and X=yttrium, hafnium, zirconium, lanthanum or combination thereof, having about 0 to 25 wt % chromium, about 1 to 25 wt % aluminum, about 1 to 35 wt % silicon, and up to about 5.0 wt %, preferably about 0.25 to 1.5 wt % of yttrium, hafnium, zirconium, lanthanum, scandium or combination thereof, the balance being a mininum of 40 wt % M. The overlay coating may be deposited by a variety of methods including but not limited to physical vapor deposition (PVD), thermal spray, plasma transferred arc, and slurry costing techniques with reaction sintering occurring simultaneously with deposition or following deposition. In the case where reaction sintering does not occur during deposition, the overlay coating and substrate are heat-treated subsequently at a soak temperature in the range of about 500 to 1200° C. for at least about 10 minutes to initiate reaction sintering.

The inclusion of silicon in the blended powder produces lower melting point constituents during the reaction sintering process, thereby allowing the molten alloy to wet the surface of the substrate and produce an effective diffusion bond between the coating and the substrate. The silicon additions also are believed to prevent the formation of brittle carbides at the coating/substrate interface. At silicon concentration of 6 wt % or higher, the silicon dissolves chromium carbides formed in the substrate and re-precipitate these randomly as the silicon concentration falls below 6 wt % due to silicon diffusion into the substrate.

It is preferred to pre-react certain of the constituents with each other, such as by atomizing chromium, aluminum and silicon to form a CrAlSi powder prior to blending with nickel and NiCr powders. Pre-reacting of powders retards the rate of exothermic reaction of the powders and reduces the amount of heat evolved during reaction stirring. The coated workpiece is heated to a temperature of at least about 500° C. to 1100° C. to initiate reaction sintering of the coating on the workpiece substrate and the temperature is increased up to 1200° C. to provide a continuous impermeable coating bonded to the substrate without a sharp dividing line between the coating and the substrate and to provide random distribution of aluminum nitrides at the coating/substrate interface.

In accordance with a preferred embodiment of the present invention, the overlay coating is deposited in a thickness of about 50 to 6000 $\mu$m, preferably in a thickness about 120 to 500 $\mu$m, more preferably 150 to 350 $\mu$m, where the MCrAlXSi is NiCrAlYSi blended powder and has, by weight, up to 25 wt % chromium, about 4 to 20 wt % aluminum, about 3 to 20 wt % silicon, and about 0.5 to 1.5 wt % yttrium, the balance being a minimum of 40 wt % nickel.

In a preferred embodiment, a MCrAlXSi alloy coating comprising 22 wt % Cr, 10 wt % Al, 1 wt % Y and 3 wt % Si, the balance Ni, promoted a Cr-carbide layer at the coating/substrate interface which functioned as a diffusion barrier effective to retain aluminum within the coating. The presence of the silicon in the MCrAlX coating also improved a Cr-based scale produced by the overlay coating.

It is still a further object of the present invention to provide an MCrAlX alloy additionally having silicon and/or a T element selected from the group consisting of tantalum, titanium, platinum, palladium, rhenium, molybdenum, tungsten, niobium, boron or combination thereof, to enhance the coating properties.

In this aspect of the invention, a MCrAlXSiT alloy is provided in which M=nickel, cobalt, iron or mixture thereof, X=yttrium, hafnium, zirconium, lanthanum, scandium, or mixture thereof, and T=tantalum, titanium, platinum, palladium, rhenium, molybdenum, tungsten, niobium, or combination thereof, having about 0 to 40 wt % chromium, about 3 to 30 wt % aluminum, up to about 5 wt % X, 0 to 40 wt % silicon, and up to about 10 wt % T, the balance M. Preferably the MCrAlXSiT alloy has about 10 to 25 wt % chromium, 4 to 20 wt % aluminum, up to 3 wt % X, up to 35 wt % silicon and up to 10 wt % T. More preferably, the X is present in amount of 0.25 to 1.5 wt %, silicon is present in amount up to 15 wt % and the T is present in amount of 0.5 to 8.0 wt %, most preferably T in the amount of 0.5 to 5.0 wt %.

And a still further object of the invention is the application of a blended powder slurry composition to a substrate to produce a desired MCrAlX or MCrAlXSiT.

In accordance with a preferred embodiment of this aspect of the invention, a mixture of two or more powders of the constituents of a MCrAlXSiT are blended with an effective amount of a binder to adherently coat a workpiece, and the workpiece with MCrAlXSiT coating is heated to a temperature for reaction sintering of the coating and adherent bonding of the coating onto the workpiece.

This method of the invention for providing a protective and inert coating to carbon steel and stainless steel at temperatures up to 1150° C. can comprise depositing onto a steel substrate and metallurgically bonding thereto a continuous overlay coating of a MCrAlXSi alloy, when M=nickel, cobalt or iron or mixture thereof and X=yttrium, hafnium, zirconium, lanthanum or combination thereof, having about 0 to 40 wt % chromium, about 3 to 40 wt % aluminum, about 0 to 35 wt % silicon, and up to about 5.0 wt %, preferably about 0.25 to 1.5 wt % of yttrium, hafnium, zirconium, lanthanum, scandium or combination thereof, the balance being a minimum of 40 wt % M. The overlay coating may be deposited by a variety of methods including but not limited to physical vapour deposition (PVD), thermal spray, plasma transferred arc, and slurry coating techniques with reaction sintering occurring simultaneously with deposition or following deposition. In the case where reaction sintering does not occur during deposition, the overlay coating and substrate are heat-treated subsequently at a soak temperature in the range of about 500 to 1200° C. for at least about 10 minutes to initiate reaction sintering.

The high temperature stainless steel substrate comprises, by weight, 18 to 38% chromium, 18 to 48% nickel, the balance iron and alloying additives, and preferably is a high chromium stainless steel having 31 to 38 wt % chromium or a low chromium steel having 20 to 25 wt % chromium. For ethylene furnace applications the workpiece substrate preferably is high temperature stainless steel.

In accordance with another embodiment of the invention, a high temperature stainless steel substrate, continuously surface alloyed with MCrAlXSi alloy by reaction sintering within a thickness of about 150 to 500 $\mu$m is aluminized by depositing a surface layer of aluminum, aluminum alloy containing up to 60 wt %, preferably up to 15 wt %, silicon, or aluminum alloy containing up to 60 wt % silicon, a total of up to 30 wt % of at least one of chromium and titanium, the balance at least about 20 wt % aluminum, thereon and heat-treating at a soak temperature in the range of about 1000 to 1160° C. for at least about 10 minutes preferably in an oxygen-free atmosphere to establish a multiphased microstructure. The aluminum or aluminum alloy surface layer preferably is deposited on the overlay in a thickness up to about 50%, preferably up to about 20%, of the MCrAlXSi thickness such as by magnetron sputtering physical vapour deposition at a temperature in the range of about 200° to 500° C., preferably at about 300° C., and the surface alloyed substrate with aluminum overlayer is heated to the soak temperature.

The systems subsequently can be heated in an oxygen-containing atmosphere at a temperature above about 1000°

C., preferably in the range of above 1000° C. to 1160° C., in a consecutive step or in a separate later step for a time effective to form a surface layer of ∝-alumina thereon.

DESCRIPTION OF THE PREFERRED EMBODIMENTS

In accordance with the present invention there are provided several embodiments of surface alloy structures generatable from the deposition of two or more powders of the constituents of a MCrAlXSi alloy, and the heating of the workpiece with the coating in a vacuum or an oxygen-free atmosphere to a temperature for reaction sintering of the MCrAlXSi alloy and diffusion bonding of the alloy to the substrate.

In a first embodiment of the invention two or more powders of the constituents of MCrAlYSi alloy are blended together and isostatic pressed onto the workpiece surface. The workpiece with the pressed overlay coating is heated in a vacuum or in an oxygen-free atmosphere until the reaction sintering takes place. In reaction sintering, it is necessary to balance the chemical activity of the components in order to avoid a violent reaction. When coatings are being produced the reaction should also occur at a temperature where adhesion of the coatings to the substrate will take place. An example of an uncontrolled reaction is given by the formation of NiAl intermetallic from Ni and Al powders. The reaction between Ni and Al starts at 800 to 900° C. The temperature rises rapidly to ~1600° C., producing molten droplets of NiAl on a relatively cold substrate surface. The droplets quickly solidify and do not react with the substrate because of the low substrate temperature and high chemical stability of NiAl. In accordance with the present invention, the activity of the powder is controlled in order to avoid a violent reaction between powders. Some of the constituents, such as Si and Al, are pre-reacted to lower their activity. For example, atomized CrAlSi powder is blended with Ni and NiCr powders. This reduces the amount of heat evolved during the reaction and the reaction occurs at higher temperatures. At elevated temperatures the coating reacts with the substrate surface producing an excellent coating/substrate bond. The addition of Si to the coating is necessary to produce low melting point liquids (900–1000° C.) with Fe and Ni. These liquids wet the surface of the substrate and produce bonding between the coating and the substrate. The Si additions are also used to prevent the formation of brittle carbides at the coating/substrate interface. At initial concentrations of 6 wt % or higher, Si dissolves the chromium carbides found in the substrate and re-precipitates them randomly as the Si concentration falls below 6% Si due to diffusion into the substrate.

In a second embodiment of the invention, two or more powders of the constituents of MCrAlYSi-alloy are blended together and deposited as a coating onto the workpiece surface by thermal spray or by magnetron sputtering from a previously thermal sprayed cathode. The workpiece with coating is then heated in a vacuum or in an oxygen-free atmosphere until the reaction sintering takes place.

In a third embodiment of the invention, two or more powders of the constituents of MCrAlYSi-alloy are blended together and deposited onto the workpiece surface by plasma transferred arc process, which performs the reaction sintering process simultaneously with the deposition.

In a fourth embodiment of the invention, two or more powders of the constituents of MCrAlYSi-alloy are blended with an effective amount of an organic binder if necessary, and mixed with a solvent combined with a viscous transporting agent in order to be deposited as slurry onto the workpiece surface. The workpiece, with the overlay slurry coating is dried prior to heating in vacuum or in oxygen free atmosphere until the reaction sintering takes place.

One of the advantages of the reaction sintering process is that a sharp dividing line between the coating and the substrate is not formed. Not only does it result in better bonding between the coating and the substrate but in the case of MCrAlY alloys on a nitrogen containing substrate it will result in a random distribution of brittle aluminum nitrides. In an MCrAlY coating deposited by the PVD process these nitrides can form brittle layers at the coating/substrate interface resulting in coating delamination.

The coating provides a source of aluminum to provide an ∝-alumina based layer at the surface thereof by introducing an oxygen-containing gas such as air at a temperature above about 1000° C. at the termination of the heat soak as a consecutive step, upon heating of the substrate and coating in a gaseous oxidizing atmosphere such as air at a temperature above 1000° C. in a separate step, or during commercial use by the introduction of or presence of an oxygen-containing gas at operating temperatures above about 1000° C.

The fifth embodiment of surface alloy structure of the invention comprises depositing a layer of aluminum on top of the said MCrAlXSi surface alloy structure and heat treating the composite of aluminum and MCrAlXSi surface alloyed substrate to establish the desired coating microstructure.

Each of the above embodiments optionally is pre-oxidized to form a protective outer layer of predominantly ∝-alumina. The ∝-alumina layer is highly effective at reducing or eliminating catalytic coke formation. These surface alloys are compatible with high temperature commercial processes at temperatures of up to 1150° C. such as encountered in olefin manufacturing by hydrocarbon steam pyrolysis typified by ethylene production.

The additive silicon can be present in the amount of 0 to about 40 wt %, preferably 3 to 15 wt %. The additive T can be present in an amount of 0 to 10 wt %, preferably 0.1 to 5 wt %, and more preferably 0.5 to 3 wt %. A preferred additive T is titanium, tantalum, platinum or palladium, tungsten, molybdenum, niobium, rhenium, boron or combination thereof in an MCrAlX comprised of 0 to 40 wt % chromium, preferably about 12 to 25 wt % chromium, about 4 to 15 wt % aluminum, preferably about 4 to 15 wt % aluminum, up to about 5 wt %, preferably about 0.5 to 1.5 wt % yttrium, the balance nickel. The addition of silicon to the McrAlX coating improves the resistance to both hot corrosion and oxidation. The addition of tantalum and tungsten in Cr-based coatings imparts improved resistance to sulphidation and oxidation. The presence of molybdenum to an alumimum-forming alloy improves the quality of the Cr-based oxide scale which forms once aluminum has been deleted from the coating alloy. The inclusion of titanium in the McrAlX alloy composition improves the coatings resistance to hot corrosion, particularly resistance to sulphide and/or halide bearing compounds. Niobium additions strength the coating, altering the coating thermal expansion coefficient to match the thermal expansion of the substrate. The presence of palladium, platinum or rhenium provides a superior, slower growing alumina scale. A preferred composition is MCrAlXSi comprising 22 wt % Cr, 10 wt % Al, 1 wt % Y, 3 wt % Si, the balance nickel.

The thickness of the MCrAlXSi or MCrAlXT overlay coating may vary from 20 to 6000 μm, preferably 50 to 2000 μm, and more preferably 80 to 500 μm in thickness.

A surface layer of aluminum, aluminum alloy containing up to 50 wt %, preferably up to 15 wt %, of silicon, or aluminum alloy containing up to 60 wt % silicon, a total of up to 30 wt % of at least one of chromium and titanium, the balance at least about 20 wt % aluminum, may be deposited onto the MCrAlXSi or MCrAlXT coating in an amount up to 50% of the thickness of the coating. A preferred top layer is a layer of aluminum or aluminum alloy having a thickness up to 20% of the thickness of the MCrAlSi or MCrAlXT overlay coating.

An industrial embodiment of the coating of the invention is a coking and corrosion resistant reactor tube for use in high temperature environments such as a furnace for ethylene production comprising an elongated tube of a high temperature stainless steel and a continuous coating metallurgically bonded on the inner surface of the elongated tube comprising a MCrAlXSiT alloy wherein M is nickel, cobalt, iron or a mixture thereof, X is yttrium, hafnium, zirconium, lanthanum, scandium or combination thereof, and T is tantalum, titanium, platinum, palladium, rhenium, molybdenum, tungsten, niobium or combination thereof, and comprising, by weight, about 10 to 25% chromium, about 4 to 20% aluminum, up to about 3 wt % X, up to about 40 wt % Si, and up to about 8 wt % T, the balance M, deposited by one of several methods including physical vapor deposition, plasma thermal spray or plasma transferred arc surfacing, or applied by a binder coating, and wherein the MCrAlXT coating has a thickness of about 20 Fm to 6000 Fm.

It has been found that a MCrAlXSi coating silicon is present in an amount of 3 to 40 wt % can be applied to a substrate of carbon steel or low-grade or high-temperature stainless steels such as tubes and fittings by adding a blended powder of two or more of the MCrAlXSi constituents to an organic binder to form a slurry and coating the substrate with the slurry. The coated substrate is dried and heated in a vacuum furnace for evaporation of the organic binder and for reaction sintering of the coating with the substrate for adhesion of the coating to the substrate.

A preferred slurry composition comprises at least two powder constituents of MCrAlXSi of which M is nickel. The powder is blended and is added to an organic binder such as an acrylic binder dissolved in an organic solvent. The nickel has a relatively smaller average size of 2 to 10 Fm, compared to the average size of 50 to 150 Fm for the remaining constituent or constituents, and has an irregular shape compared to the rounded or spherical shape of the remaining constituent or constituents. The size and shape variations permit the particles to interlock and to remain on the substrate once the organic binder has evaporated, to be described.

The inclusion of up to 40 wt % silicon in the blended powder lowers the melting point of the coating to about 900 to 1150° C. At silicon concentration of 6 wt % or higher, the silicon dissolves chromium carbides formed in the substrate and re-precipitate these randomly as the silicon concentration falls below 6 wt % due to silicon diffusion into the substrate.

It will be understood, of course, that modifications can be made in the embodiments of the invention illustrated and described herein without departing from the scope and purview of the invention as defined by the appended claims.

What is claimed is:

1. A method for providing a protective and inert coating on carbon steel and stainless steel comprising depositing onto a carbon steel or stainless steel substrate and metallurgically bonding thereto by reactive sintering a continuous coating of a MCrAlXSi alloy, where M=nickel, cobalt or iron or mixture thereof and X=yttrium, hafnium, zirconium, lanthanum, scandium or combination thereof, having about 10 to 40 wt % chromium, about 1 to 25 wt % aluminum, about 1 to about 40 wt % silicon and 0.25 to about 5 wt % X, the balance at least 40 wt % M.

2. A method as claimed in claim 1 in which the coating is deposited by physical vapour deposition, thermal spray, plasma transferred arc, isostatic pressing or by slurry coating.

3. A method as claimed in claim 1, in which the MCrAlXSi additionally comprises 0.1 to about 10 wt % of an element T selected from the group consisting of tantalum, titanium, platinum, palladium, rhenium, molybdenum, tungsten, niobium, or combination thereof, and methallurgically bonding the coating to the substrate by heat-treating the coating and substrate to a soak temperature for a time effective to provide a multiphased microstructure change and to metallurgically bond the coating to the substrate.

4. A method as claimed in claim 1 in which at least two powder constituents of the MCrAlXSi alloy are partially pre-reacted and then blended together with remaining constituents the blended constituents are deposited onto the substrate as the coating, and the coated substrate heated in a vacuum or an oxygen-free atmosphere to a temperature above 500 to about 1200° C. for a time effective to initiate reactive sintering and to metallurgically bond the coating as a continuous impermeable coating to the substrate.

5. A method as claimed in claim 4 in which chromium, aluminum and silicon are atomized to form a CrAlSi alloy powder prior to blending with nickel, NiCr or NiAl powders, or combinations thereof.

6. A method as claimed in claim 4 in which the coating is deposited in a thickness of about 50 to 6000 $\mu$m and in which the MCrAlXSi coating comprises about 10 to 20 wt % chromium, about 4 to 20 wt % aluminum, about 5 to 20 wt % silicon, and about 0.25 to 1.5 wt % yttrium, the balance being a minimum 40 wt % nickel.

7. A method as claimed in claim 6 in which the substrate is a high chromium stainless steel having 18 to 38 wt % chromium, 18 to 48 wt % nickel, the balance iron and alloying additives and in which the coating is deposited in a thickness of about 120 to 500 $\mu$m.

8. A method as claimed in claim 7 in which the coating is deposited in a thickness of about 150 to 350 $\mu$m and in which the coating is aluminized by depositing a layer of aluminum having a thickness up to about 20% of the McrAlXSi coating onto said coating and heat-treating the aluminum layer at a soak temperature in the range of about 1000 to 1160° C. for at least 10 minutes effective to establish a multiphased structure.

9. A method as claimed in claim 8 in which the layer of aluminum is deposited in a thickness of about 20% of the MCrAlXSi coating by magnetron sputtering at a temperature in the range of about 200 to 500° C.

10. A method as claimed in claim 8 in which the substrate, MCrAlXSi coating and the aluminum layer are subsequently heated in an oxygen-containing atmosphere at a temperature in the range of 1000 to 1600° C. for a time effective to form a layer of $\alpha$-alumina thereon.

* * * * *